US005170023A

United States Patent [19]

Pham et al.

[11] Patent Number: 5,170,023

[45] Date of Patent: Dec. 8, 1992

[54] CIRCUIT BREAKER WITH VARISTOR-ASSISTED INTERRUPTION

[75] Inventors: Van Doan Pham; Joseph Martin; Edmond Thuries, all of Meyzieu, France

[73] Assignee: GEC Alsthom SA, Paris, France

[21] Appl. No.: 661,167

[22] Filed: Feb. 27, 1991

[30] Foreign Application Priority Data

Feb. 27, 1990 [FR] France ..... 90 02416
May 31, 1990 [FR] France ..... 90 06787

[51] Int. Cl.[5] ..... H01H 33/16; H01H 33/82

[52] U.S. Cl. ..... 200/144 AP; 200/148 R; 200/148 A

[58] Field of Search ..... 200/144 AP, 144 R, 148 R, 200/148 B, 148 D, 148 F, 148 BV

[56] References Cited

U.S. PATENT DOCUMENTS 3,912,974 10/1975 Hill .
4,439,651 3/1984 Thuries et al. ..... 200/144 AP

FOREIGN PATENT DOCUMENTS 0106315 4/1984 European Pat. Off. .
0368249 5/1990 European Pat. Off. .
1253332 11/1967 Fed. Rep. of Germany .
2251138 4/1974 Fed. Rep. of Germany .
3444317 5/1986 Fed. Rep. of Germany .
1446438 6/1966 France .
2512267 3/1983 France .
2599548 12/1987 France .
265318 3/1950 Switzerland .

*Primary Examiner*—Harold Broome
*Attorney, Agent, or Firm*—Sughrue, Mion, Zinn, Macpeak & Seas

[57] ABSTRACT

A circuit breaker comprising, for each pole, at least one interrupting chamber having fixed contacts and moving equipment including a moving contacts, and in parallel with each interrupting chamber series circuit comprising a varistor and a switch, said switch being open when the circuit breaker is disengaged and being closed when the circuit breaker is engaged. The switch comprises a moving contact driven by the moving equipment when the circuit breaker is performing an engagement operation, with the moving contact being constrained to follow the movement of the moving equipment when the circuit breaker performs a disengagement operation, but with a certain delay.

21 Claims, 7 Drawing Sheets

CIRCUIT BREAKER WITH VARISTOR-ASSISTED INTERRUPTION

The present invention relates to a high tension circuit breaker fitted with varistors to limit surge on interruption.

BACKGROUND OF THE INVENTION

High tension circuit breakers fitted with varistors exist, particularly for switching shunt reactances in electricity networks. The purpose of having varistors (also known as non-linear resistors, or as variable resistors, or as voltage-dependent resistors) is to reduce surge.

The lower the operating threshold of a varistor, the more effective the protection it provides against surge. To obtain a varistor operating threshold which is low, only a small number of varistor components should be connected in series, with the drawback that the energy absorbed by each varistor component is then high.

The limiting surge value for which varistors can provide protection is presently about 1.6 pu (where 1 pu $=Un \times \sqrt{2}/\sqrt{3}$ peak value, with Un being the nominal phase voltage).

In order to limit surge below 1.6 pu, proposals have been made to put a switch in series with the varistor for the purpose of separating the varistor from the network after the circuit breaker has been disengaged.

An object of the present invention is to provide a circuit breaker based on this principle which is simple and cheap to manufacture.

The invention is equally applicable to conventional type and to metal-clad type circuit breakers in which the varistor for each of the poles of the circuit breaker is placed in a case that is distinct from the case containing the interrupting chamber, as to circuit breakers in which the varistor is placed in the same case as the interrupting chamber.

The invention is applicable to circuit breakers having a plurality of interrupting chambers connected in series with each phase, and it applies in particular to circuit breakers having two interrupting chambers per phase in a T or a V configuration.

SUMMARY OF THE INVENTION

The invention provides a circuit breaker comprising, for each pole, at least one interrupting chamber having fixed contacts and moving equipment including moving contacts, and in parallel with each interrupting chamber a series circuit comprising a varistor and a switch, said switch being open when the circuit breaker is disengaged and being closed when the circuit breaker is engaged, wherein said switch comprises a moving contact driven by the moving equipment when the circuit breaker is performing an engagement operation, said moving contact being constrained to follow with a certain delay the movement of the moving equipment when the circuit breaker performs a disengagement operation.

In an embodiment in which the varistor is disposed in a case distinct from the case containing the interrupting chamber, with the varistor is constituted by two stacks of varistor components, the two stacks being separated by a distance not less than the isolation distance of the circuit breaker, one of the stacks having said moving contact constituted by a metal rod passing therethrough, the metal rod being fixed to a flexible metal drive member interconnecting the two cases outside the cases and above them, one end of the second stack of components being provided with a female contact co-operating with said rod.

Said flexible drive member is fixed, inside the case containing the interrupting chamber, to an arm which is urged towards the moving equipment by a spring, said arm being capable of being put into mechanical contact with the moving equipment by means of insulating rods.

Said arm carries a first cylinder provided with a flange co-operating with a second cylinder which is fixed and which is provided with a flange to define a variable volume, said variable volume being at a maximum when the circuit breaker is in the engaged position, said volume being closed, but leaky and constituting a device for delaying motion of said arm during a circuit breaker disengagement operation.

Advantageously, one of said cylinders carries an adjustable valve.

In another embodiment, in which the varistor is disposed in the same case as the interrupting chamber, the varistor is constituted by two stacks of varistor components, the two stacks being separated by a distance not less than the isolation distance of the circuit breaker, one of the stacks having said moving contact in the form of a metal rod passing therethrough, with the other stack being provided with a female contact for receiving said rod.

Said metal rod is fixed to a first end of an insulating rod whose other end is fixed to a moving arm, said arm being urged by a spring towards the moving equipment, said arm being put into contact with the moving equipment by means of insulating rods, arms and fingers.

Said arm carries a first cylinder provided with a flange and co-operating with a second cylinder which is fixed and provided with a flange to define a variable volume, said volume being at a maximum when the circuit breaker is in the engaged position, said volume being closed, but leaky and constituting a device for delaying the motion of said arm during a circuit breaker disengagement operation.

Advantageously, one of said cylinders carries an adjustable valve.

In a variant, in which the varistor is disposed in the same case as the interrupting chamber, the varistor is constituted by a single stack of varistor components, said moving contact being in the form of a metal rod fixed to a moving arm, said arm sliding in a guide tube fixed to an insulating cone, one end of the stack carrying a female contact that co-operates with said rod.

Said arm carries a first cylinder provided with a flange and co-operating with a second cylinder which is fixed and provided with a flange, to define a variable volume, said variable volume being at a maximum when the circuit breaker is in the engaged position, said volume being closed, but leaky and constituting a device for delaying the motion of said arm during a circuit breaker disengagement operation.

One of said cylinders carries an adjustable valve.

To limit the voltages on the varistors, resistor disks are inserted in the varistor component stacks.

Said flexible drive member is in contact with the operating rod of the circuit breaker via a delay member.

The invention also provides a circuit breaker comprising, for each pole, at least one insulating case containing an interrupting chamber with fixed contacts and with moving equipment including moving contacts, and a second insulating case containing a series connection of a varistor and an interrupter connected in parallel with each interrupting chamber, said switch being opened when the circuit breaker is disengaged and closed when the circuit breaker is engaged, said circuit breaker further including a resistance inside each interrupting chamber and associated with a mechanism for inserting the resistance briefly while the circuit breaker is being closed, wherein said switch includes a moving a contact connected to the mechanism for inserting the resistance by a flexible drive member which interconnects the two cases outside the cases.

In general, the invention relates to any circuit breaker (a conventional circuit breaker having an insulating case or a metal-clad circuit breaker) provided with a varistor associated with a switch in which said switch is operated by a flexible metal drive member, with the main chamber having a case that is insulating or metal clad.

By providing drive by means of a flexible drive member it is possible to avoid having a system that includes any connecting rods, thereby making the apparatus particularly simple and very reliable.

The apparatus is very simple, with the switch and the varistor being disposed inside a porcelain case filled with sulfur hexafluoride ($SF_6$). The series switch has an interrupting gap and a disengagement speed which are both smaller than the corresponding gap and speed in the interrupting chamber.

Another feature of the invention serves to improve the interrupting power of the series switch while nevertheless retaining acceptable voltage stress on the varistor when the circuit breaker is in the disengaged position.

This is achieved by making the series switch in such a manner that when it is in the open position its capacitance lies in the range 0.6 times to 1.1 times the capacitance of the varistor.

In a first embodiment, the means for imparting the desired capacitance to the switch comprise first and second facing fixed metal capacitor plates respectively in electrical contact with the moving contact and with the fixed contact of the switch.

The said capacitor plates may be in the form of rings or they may be in the form of large flat surfaces facing each other.

In a second embodiment, the means for imparting the desired capacitance to the switch comprise at least one cylinder of material having a high dielectric constant, the cylinder being in electrical contact via its respective ends with fixed plates in electrical contact respectively with the moving contact and with the fixed contact of the switch.

In a first embodiment, the cylinders are made of quartz Araldite.

In a variant, the said cylinder is a commercially-available capacitor.

BRIEF DESCRIPTION OF THE DRAWINGS

Embodiments of the invention are described by way of example with reference to the accompanying drawings, in which.

DETAILED DESCRIPTION

Figure 1:
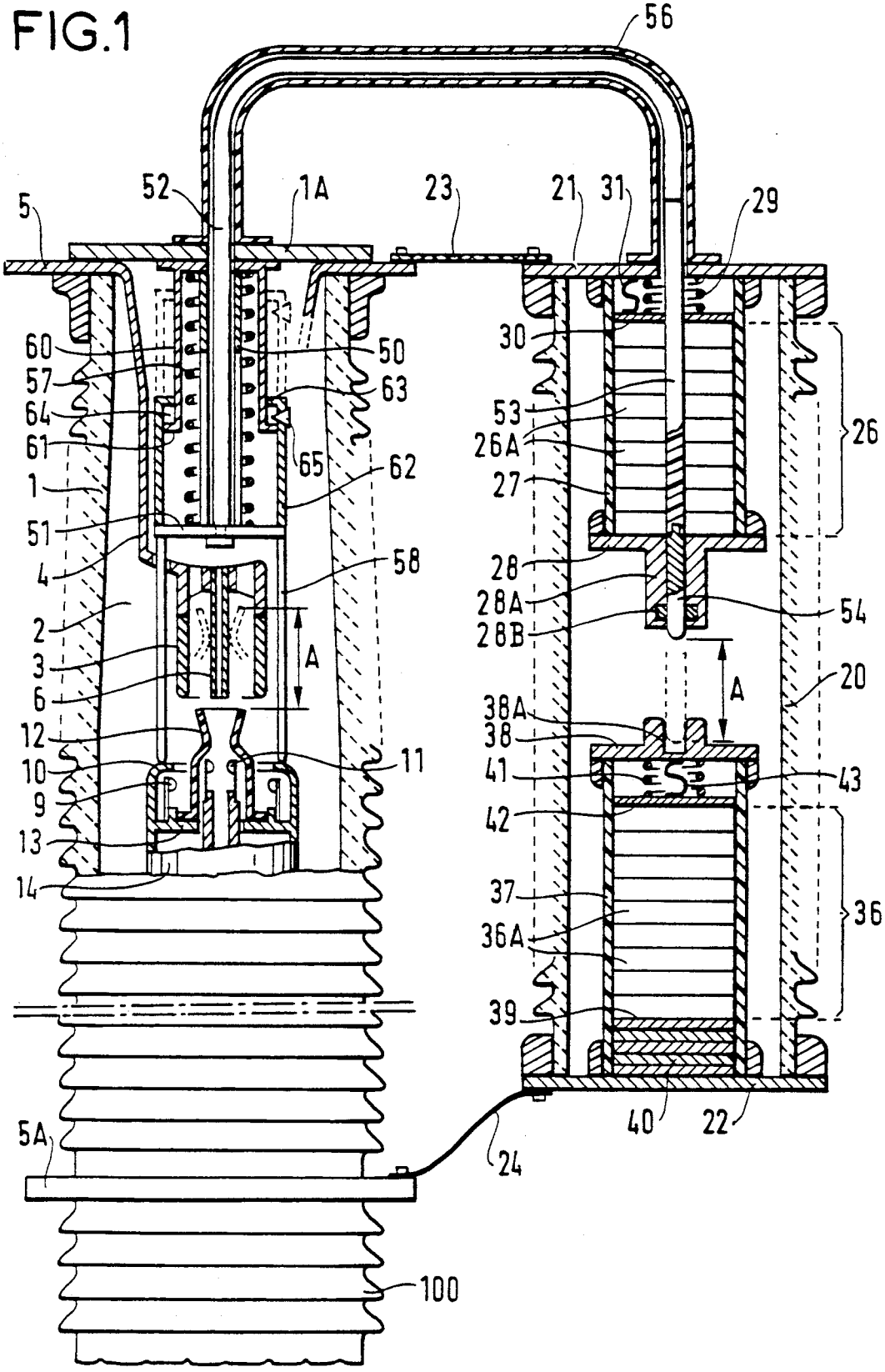
FIG. 1 is a fragmentary axial section through one pole of a circuit breaker of the invention in which the interrupting chamber and the varistor are disposed in distinct cases.

The circuit breaker of FIG. 1 is shown in its disengaged position. It comprises an insulating case 1 preferably made of porcelain, enclosing the interrupting chamber and standing on an insulating column 100 of which only a portion is shown. The case 1 is closed at the top by a metal cove 1A.

The inside 2 of the case is gastight and contains a gas having high dielectric strength, e.g. sulfur hexafluoride, at a pressure of a few bars.

The circuit breaker comprises a fixed main contact constituted by a tube 3 which is mechanically and electrically connected by arms 4 to a first current terminal 5 which is in electrical contact with the cover 1A. The contact 3 is fixed to a fixed arcing contact 6 likewise constituted by a tubular part. The contact 6 is electrically connected to the contact 3.

The moving equipment of the circuit breaker comprises a moving main contact formed by contact fingers 9 which are protected by an anti-corona cap 10 and which co-operate with the tube 3. The moving equipment also includes an arcing contact constituted by fingers 11 co-operating with a blast nozzle 12. The blast means do not form part of the present invention and they are not shown. The moving equipment is connected in conventional manner to a drive rod (not shown). The moving electrical contacts are interconnected electrically by a disk 13 which is itself fixed to a metal cylinder 14 which is electrically connected via sliding contacts (not shown) to a second current terminal 5A.

The varistor is disposed inside a gastight insulating case 20 which is closed at its ends by metal plates 21 and 22 which are electrically connected to the terminals of the circuit breaker via conductors 23 and 24. The inside of this case is filled with sulfur hexafluoride.

The varistor is made up of varistor components in the form of disks based on zinc oxide and stacked in two separate but colinear stacks 26 and 36.

The stack 26 made up of components 26A is placed inside an insulating cylinder 27 which is fixed beneath the top plate 21. The cylinder 27 is closed at its bottom end by a metal plate 28 which is extended by a cylindrical portion 28A. The bottom component of the stack 26 is in close contact with the plate 28 because of pressure exerted by a spring 29 bearing both against a metal plate 30 on the top of the stack 26 and against the plate 21. A metal braid 31 ensures electrical continuity between the stack 26 and the plate 21.

Each of the disks 26A in the stack 26 has a central hole so that the axis of the stack has a cylindrical channel along which a rod may slide, as described below. Similarly, the cylindrical portion 28A has a central bore for passing the rod.

The stack 36 is placed inside an insulating cylinder 37 which is fixed on top of the plate 22. The components 36A of the stack 36 do not have central holes. The top of the cylinder 37 has a metal cover 38 fixed thereto and provided with a cylindrical projection 38A for receiving the rod mentioned above. Resistor disks 40 whose function is explained below are disposed between the bottom component of the stack 36 and the plate 22, and are separated from the stack by a metal washer 39. The stack is compressed by a spring 41 bearing both against the cover 38 and against a metal plate 42 on top of the stack 36. A metal braid 43 ensures electrical continuity between the stack 36 and the plate 38.

The underside of the cover 1A carries a metal cylinder 50 provided with slots in which a metal arm 51 slides. The arm 51 has a first end of a flexible metal drive member 52 which passes through an orifice in the cover 1A. The other end of the flexible metal drive member is connected to a rod 53 of insulating material which lies on the axis of the stack 26. The other end of the rod 53 is fixed to a metal rod 54 which passes through the cylinder 28A and co-operates electrically therewith by means of sliding contacts 28B.

Outside the cases 1 and 20, the flexible drive member 52 passes inside a flexible sheath 56 which is connected in gastight manner to the cover 1A and to the cover 21.

The arm 51 is thrust by a spring 57 bearing against the cover 1A. Insulating rods 58 are fixed at one end to the arm 51 and have their opposite ends bearing against the anti-corona cap 10 of the circuit breaker.

The apparatus further includes a device for delaying displacement of the arm 51 when disengagement causes the moving equipment to move suddenly downwards in the figure from the circuit breaker engaged position. The device comprises a first cylinder 60 fixed to the cover 1A and provided with an outwardly directed flange 61, and a second cylinder 62 fixed to the arm 51 and provided with an inwardly directed flange 63 placed above the flange 61. As a result the cylinders and the flanges define a variable volume 64 which is closed, but leaky. The leak may be calibrated by a valve 65 placed on the cylinder 62, for example.

The total length of the flexible drive member 52, of the insulating rod 53, and of the metal rod 54, and the distance between the stacks 26 and 36 are chosen so that when the circuit breaker is in the disengaged position (open circuit), the rod 54 is in its position furthest away from the contact 38A, and when the circuit breaker is in its engaged position (circuit closed), the rod 54 is in contact with the contact 38A. This is equivalent to saying that the stroke A of the circuit breaker is equal to the stroke of the switch constituted by the rod 54 and the contact 38A.

The above-described apparatus operates as follows.

In the engaged position, the moving equipment is in its high position. The rods 58 are pushed back by the cap 10, the arm 51 is in its high position, the spring 57 is compressed, the volume 64 is at its maximum, and the switch 54-38A is closed. The varistor 26-36 is short-circuited by the contacts of the circuit breaker.

When the circuit breaker is disengaged, its contacts move apart very quickly. The cap 10 loses contact with the rods 58 which cannot follow the motion because of the delay device. As a result the switch 54-38A remains closed for an instant so the varistor remains connected to the terminals of the circuit breaker. If a surge occurs, then the varistor operates and performs its protective function. After a determined length of time which is adjusted by the leak of the volume 64, the arm 51 moves under the action of the spring 57. The rod 54 leaves the contact 38A, thereby disconnecting the varistor once the resulting arc has extinguished. It may be observed that the arc between the rod 54 and the contact 38 is interrupted at an instant when the arc in the interrupting chamber is already extinguished. The voltage between the rod 54 and the contact 38 is the restoration transient voltage which tends towards the nominal voltage. Since the current flowing through the varistor is very low, of the order of a few milliamps, the arc extinguishes naturally once the rod 54 has completed its stroke.

The resistors 40 serve to reduce the voltage across the varistors 26 and 36 in the event of high restored voltage.

Figure 2:
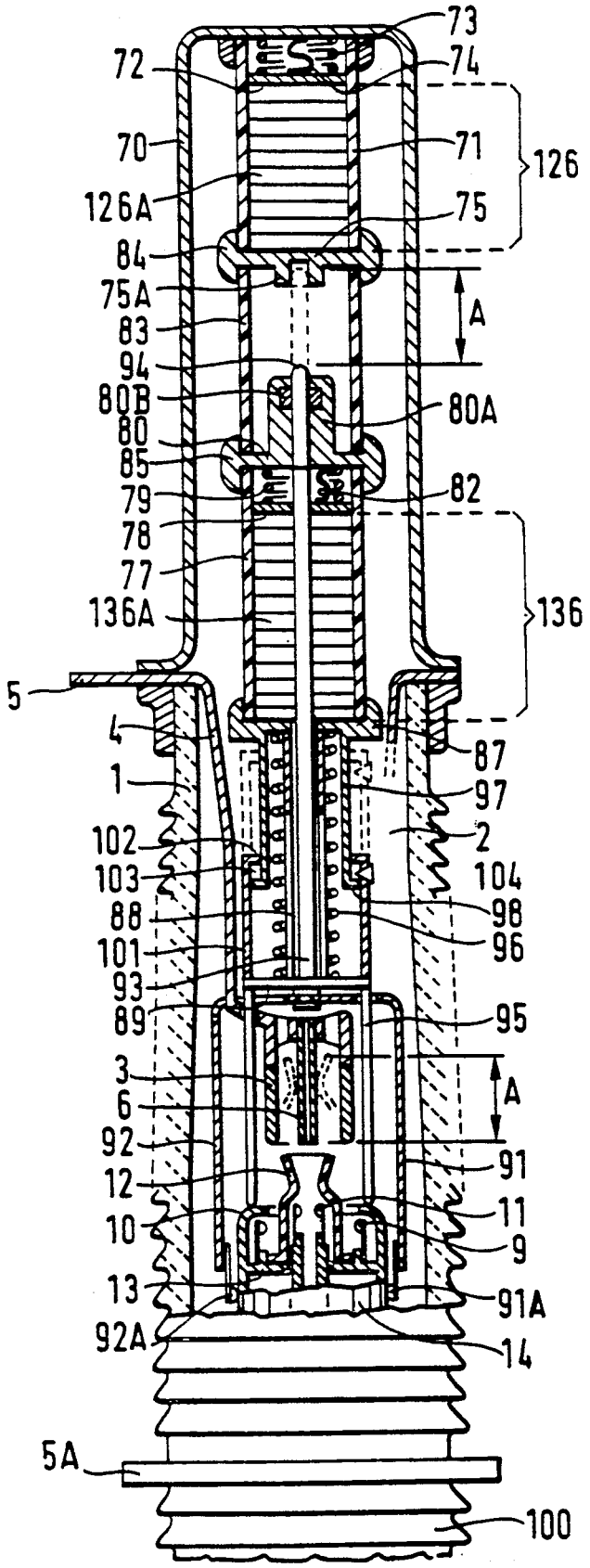
FIG. 2 is a fragmentary axial section through one pole of a circuit breaker of the invention in which the interrupting chamber and the varistor are disposed in the same case.

FIG. 2 shows an implementation of the invention in a circuit breaker where the varistor is disposed in the same case as the interrupting chamber.

Items that are common to FIGS. 1 and 2 are given the same reference numerals.

In this case the cover 1A is replaced by a metal cap 70 containing the stacks 126 and 136 of varistor components. The cap 70 is electrically connected to the terminal 5.

The stack 126 constituted by varistor components 126A in the form of disks without central holes is contained in an insulating tube 71. A metal disk 72 is placed on the top of the stack and has one end of the spring 73 bearing thereagainst with the other end of the spring bearing against the cap. A braid 74 ensures electrical continuity between the cap and the stack 126. The bottom stack of the 126 has another metal disk 75 placed in contact therewith and shaped in such a manner as to constitute a female contact 75A suitable for co-operating electrically with a contact rod.

The stack 136 made up of varistor components 136A in the form of disks having central holes is contained in an insulating tube 77. A metal plate 78 having a central hole is placed on the top of the stack 136 and serves as an abutment for a spring 79. The spring 79 also bears against a metal plate 80 having a central hole and extended by a cylinder 80A that serves to guide a contact rod. A braid 82 provides electrical continuity between the plate 78 and the plate 80.

The plates 75 and 80 are held together by an insulating tube 83 fixed to the plates via metal rims 84 and 85.

The bottom of the stack 136 is supported by a plate 87 having a central hole and extended downwards by a metal tube 88 having longitudinal slots formed therethrough to allow a metal arm 89 to slide. The metal arm 89 is connected to metal arms 91 and 92 provided with contact fingers 91A and 92A which make contact with the cylinder 14 to provide electrical continuity between the terminals 5A and 5 via the varistor 126-136.

The arm 89 is also fixed to an insulating rod 93 extended by a metal rod 94. This rod engages in the cylinder 80A and sliding electrical contacts 80B provide electrical continuity between the rod 94 and the cylinder 80A.

The arm 89 is also fixed to insulating rods 95. When the moving equipment moves upwards in the figure (circuit breaker being re-engaged), these rods drive the arm 89 and consequently displace the rod 94 whose end is engaged in the contact 75A. Naturally, the distance between the plates 75 and 80 is selected so that the stroke of the switch constituted by the rod 94 and the contact 75A is equal to the stroke of the circuit breaker. To illustrate the circuit breaker stroke, the position occupied by the nozzle when the circuit breaker is in the engaged position is represented by dashed lines.

The arm 89 is pushed back by a spring 96 placed between the plate 87 and the arm, thereby causing the arm to be urged resiliently towards the bottom of the figure.

The apparatus further includes means for breaking the displacement of the arm 89 when the circuit breaker is opened from a position in which it was closed with the spring 96 compressed, with the moving equipment of the circuit breaker moving down quickly during an opening operation. These means comprise a first cylinder 97 fixed to the plate 87 and provided with an outwardly directed flange 98, and a second cylinder 101 fixed to the arm 89 and provided with an inwardly directed flange 102 placed above the flange 98. This assembly delimits a volume 103 which is closed, but leaky. The leak can be adjusted e.g. by means of a valve 104 carried by the cylinder 101.

The apparatus operates as follows.

In the engaged position, the moving equipment is in its high position, the rods 95 are pushed back by the cap 10, the arm 89 is in its high position, the spring 97 is compressed, the volume 103 is at its maximum, and the switch 94-75A is closed. The varistor 126-136 is short circuited by the contacts of the circuit breaker.

When the circuit breaker is disengaged, its contacts move apart very quickly. The cap 10 loses contact with the rods 95 which cannot follow the motion of the cap because of the delay device. As a result the switch 94-25A remains closed for an instant so the varistor remains connected to the terminals of the circuit breaker, with currents then flowing via the terminal 5, the cap 70, the braid 74, the stack 126, the contacts 75A, the rod 94, the braid 92, the stack 136, the plate 87, the tube 88, the arms 91 and 92, the contacts 91A and 92A, the cylinder 14, and the terminal 5A. If a surge occurs, the varistor operates and performs its protective function. After a determined length of time as adjusted by the leak from the volume 103 and the valve 104, the arm 89 moves under thrust from the spring 96 so the rod 94 loses contact with the contact 75A, thereby disconnecting the varistor once the resulting arc has exteinguished. It may be observed that the arc between the rod 94 and the contact 75A is extinguished at an instant when the arc in the interrupting chamber has already been extinguished. The voltage between the rod 94 and the contact 75A is the restoration transient voltage which tends towards the nominal voltage. Since the current flowing through the varistor is very low, of the order of a few milliamps, the arc extinguishes on its own when the rod 94 reaches the end of its stroke.

Figure 3:
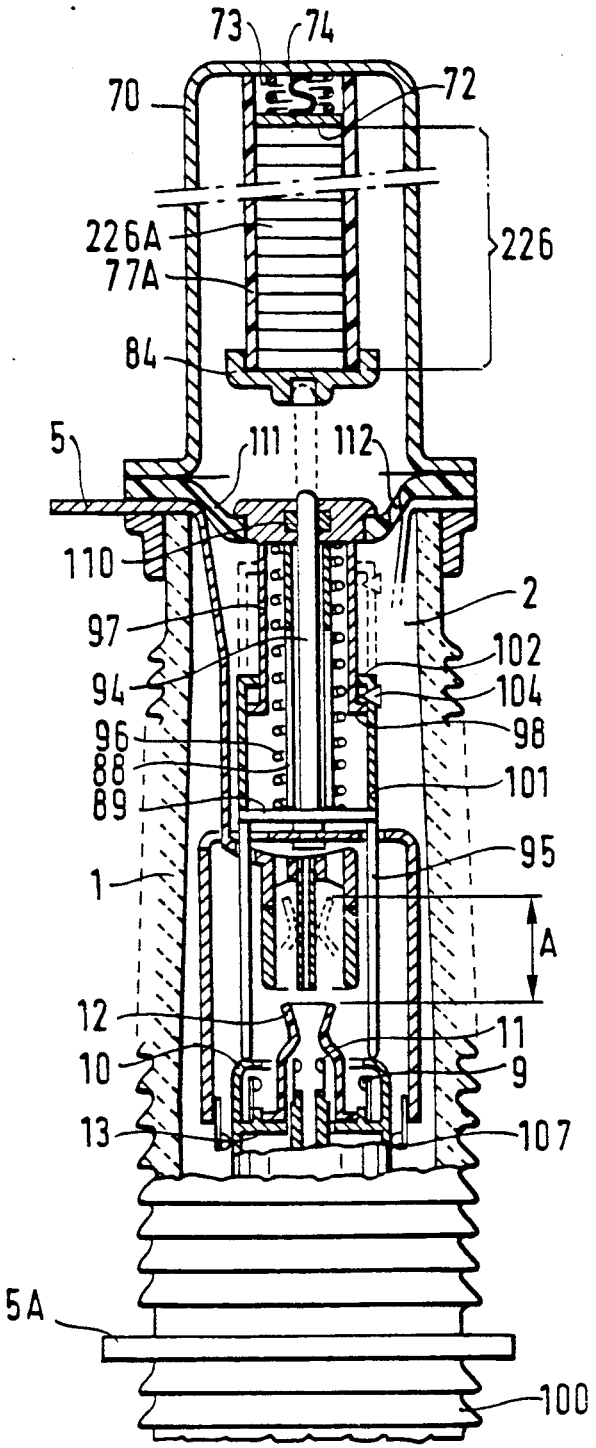
FIG. 3 is a fragmentary axial section through a variant embodiment of the circuit breaker having the varistor above the interrupting chamber.

The variant embodiment shown in part in FIG. 3 differs from that of FIG. 2 is that it has only one stack 226 of varistor components 226A, with these components being disks with no central hole.

Items which are common to this figure and to FIG. 2 are given the same reference numerals.

The stack is contained in an insulating tube 77A. A metal block 110 is fixed to an insulating cone 111 bearing against the top of the envelope 1. The block 110 carries all of the components that were carried by the disk 87 in FIG. 2, and in particular the tube 88, the arm 89, and the cylinder 97. A hole 112 through the cone 111 enables the insulating gas of the circuit breaker to pass into the cap 70.

It may be observed that it is not always necessary in the embodiments shown in FIGS. 2 and 3 for the insulating rods 95 to come into contact with the cap 10 when the circuit breaker is in the disengaged position. If the interrupting gap between the contacts 94 and 75A only needs to be of width a, where a is less than the stroke A of the circuit breaker, then when the circuit breaker is open the end of the rod 95 may be at a distance (A-a) from the cap.

It may be observed that the stacks of varistors in FIGS. 2 and 3 may include resistor components 40 like the stack 36 in FIG. 1.

Figure 4:
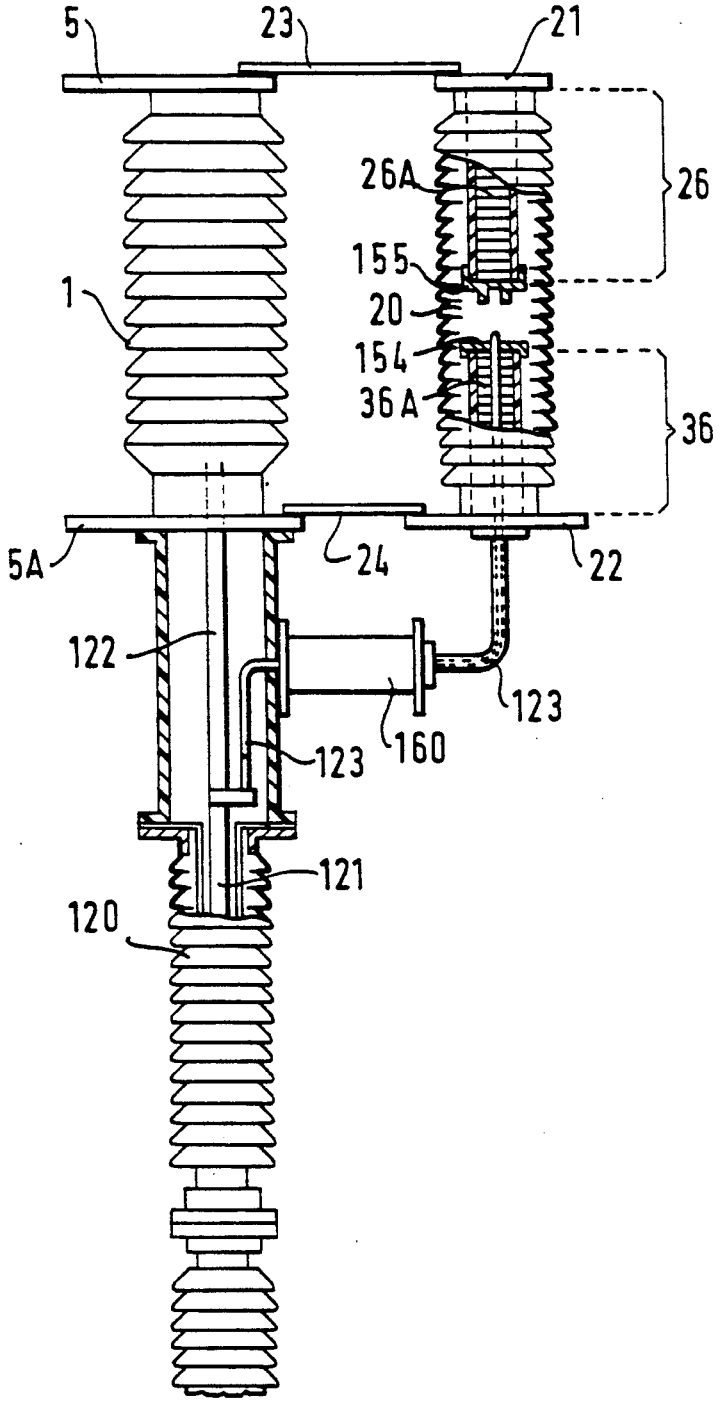
FIG. 4 is a fragmentary view of a circuit breaker of the invention having two interrupting chambers per phase in a T configuration.

FIG. 4 shows a variant embodiment of the invention applied to a circuit breaker in which the varistor is placed in a case 20 which is separate from the case 1 enclosing the interrupting chamber. However, unlike FIG. 1, the switch is driven by a mechanism which is directly connected to the drive rod of the circuit breaker.

In FIG. 4 items that are common to FIG. 4 and FIG. 1 are given the same reference numerals, with reference 120 designating the insulating column carrying the interrupting chamber and enclosing the insulating drive rod 121. The rod 121 is extended by a metal portion 122 connected to the moving equipment in the interrupting chamber. It is also extended by a flexible drive member 123 which is fixed to the rod 154 of the switch via an interposed delay mechanism 160 which may be analogous to those described above. The rod 154 of the switch co-operates with a contact fixed to the end of the varistor stack 26. The flexible drive member is placed in an insulating sheath 123A. Operation is identical to that described above.

Figure 5:
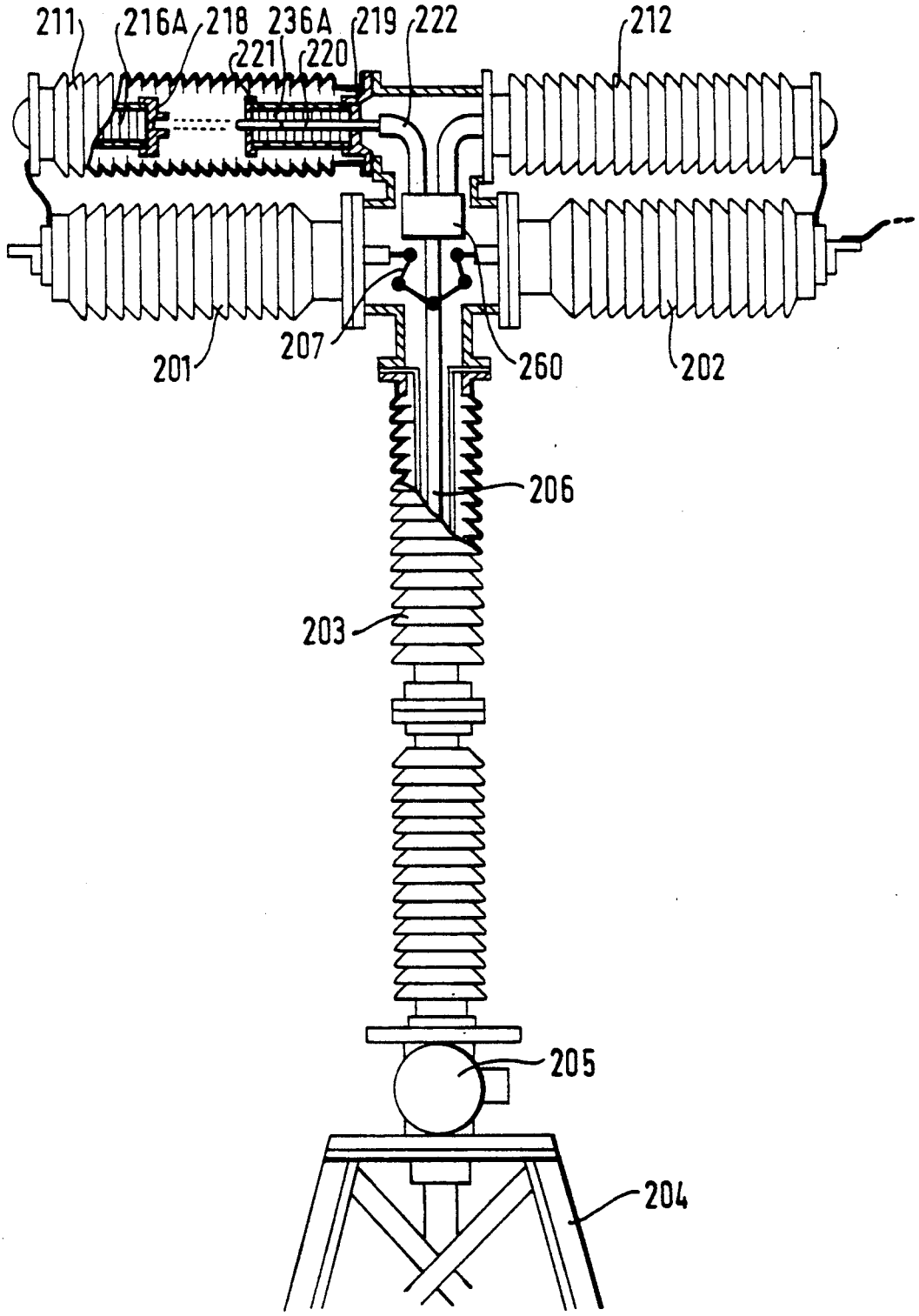
FIG. 5 is a fragmentary view of a ciruit breaker of the invention having two interrupting chambers per phase in a T configuration.

FIG. 5 shows how the invention may be applied to a circuit breaker having two interrupting chambers 201 and 202 in a T configuration.

Reference 203 designates an insulating column common to both interrupting chambers and standing on a metal frame 204 which carries a drive mechanism 205.

A drive rod 206 common to both interrupting chambers serves to open and close the two circuit breaker chambers via a mechanism 207.

Each of the interrupting chambers 201 and 202 is associated with a respective two-stack varistor case 211 or 212. Only the case 211 is shown in detail. The case 211 contains a stack of varistor components 216A having no central hole, terminated by a contact 218 and a stack of varistor components 236A having a central hole and supported by a metal cone 219 electrically connecting the end of the stack to one of the terminals of the interrupting chamber 201. An insulating flexible drive member 220 passes through the components 236A, the drive member having a first end connected to the drive rod 206 via a delay mechanism 260. The second end of the flexible drive member is connected to a metal rod 221 co-operating with the contact 218. Outside the stack of components 236A, the flexible drive member is contained in a sheath 222.

The case 212 is fitted in similar manner.

The circuit breaker operates in exactly the same manner as the circuit breakers of FIGS. 1 to 4.

French patents Nos. 2 503 448 and 2 512 267 (≈U.S. Pat. No. 4,439,651) describe a circuit breaker in which the interrupting chamber contains a "closing" resistance for protecting the circuit breaker against surges during a closing operation. The closing resistance is connected for a short period of time during circuit breaker closing by means of an insertion mechanism described in the above-specified patents.

It is possible to provide a "hybrid" circuit breaker which is protected against surges both on closing and on opening, by connecting a case containing a varistor and a switch as described with reference to FIGS. 1, 4, and 5 in parallel with the terminals of a circuit breaker having a "closing" resistance. In this case, the switch is actuated by a flexible drive member passing through the circuit breaker column and connected to the insertion mechanism mentioned above.

When under a permanent operating voltage, the varistor behaves like a capacitor. In conventional high tension circuit breaker applications, the capacitance of the varistor lies in the range about 20 picofards to about 30 picofards, with the exact value depending on the diameter and the length of the varistor.

If the series switch has its own capacitance of the same order of magnitude, then the voltage restored across its terminals will be about one-half the voltage applied to the interrupting chamber which is connected in parallel with the series-connected varistor and switch.

In the event of 2 pu in phase opposition, for example, then the varistor will be subjected to a voltage of no more than 1 pu.

Figure 6:
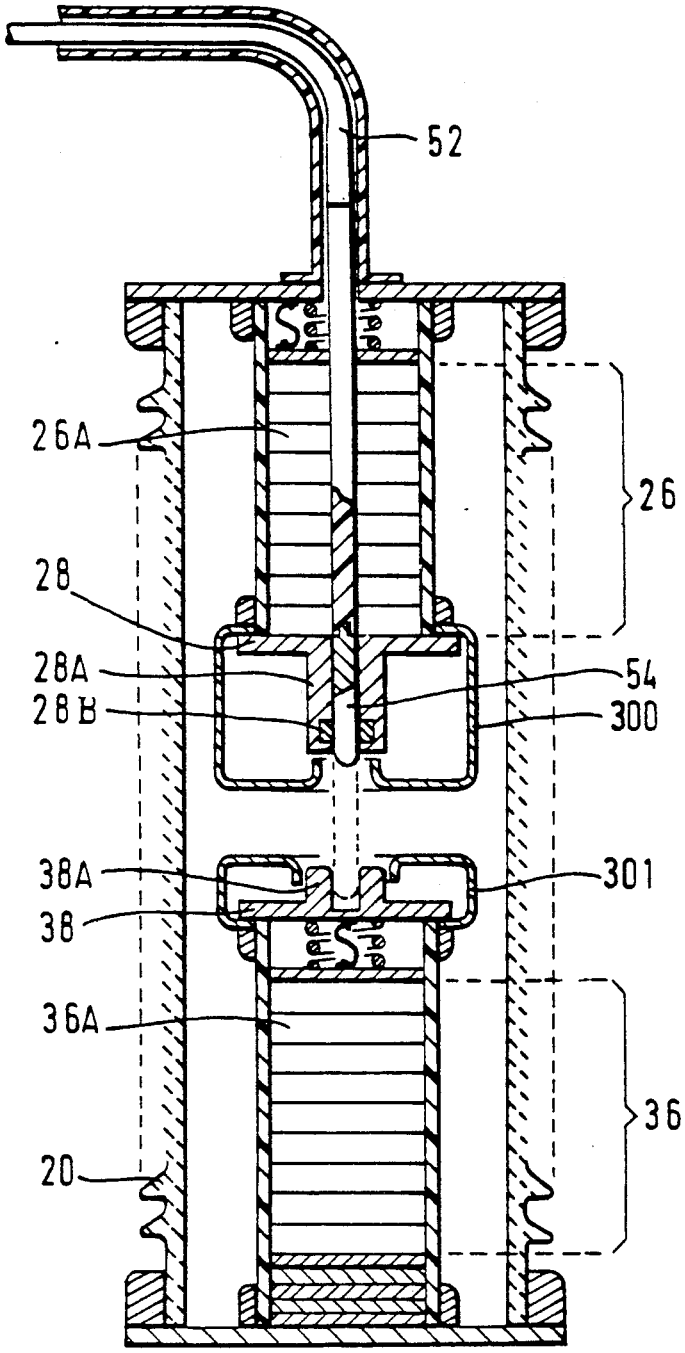
FIG. 6 is an axial section through the case containing the varistor and the switch in series, said switch being provided with rings.

FIG. 6 shows first means for giving the series switch a capacitance that is close to that of the varistor.

In order to give the switch the desired capacitance, it is fitted with a first capacitor plate 300 in electrical connection with the moving contact 54 via the contacts 28B and the block 28A, and a second capacitor plate 301 in electrical connection with the contact 38A via the metal block 38.

The capacitor plates are fixed and face each other and may be in the form of washers or in any other shape providing they have large plane surface areas facing each other.

When the switch in its open position, it is easy to give it the desired capacitance by an appropriate selection of plate area and plate separation.

If the capacitor plates are plane surfaces of area S (in $cm^2$) and if they are separated by a distance d (in cm), then the capacitance C (in picofarads) of the capacitor formed by the plates is given by the conventional formula:

$$C=0.138\ KS/d$$

where K is a coefficient depending on the gas in the case 20 and may be taken as being equal to 1 for sulfur hexafluoride.

It may be observed that when the circuit breaker is in the engaged position, the distance between the capacitor plates is well determined. The varistor and capacitor plate assembly may be used to protect the line against high value lightening shocks or high value operating surges. The capacitor plates then act as a discharge gap, and an arc struck between them brings the varistor into circuit and causes it to absorb all of the energy in the lightening shock or in the operating surge.

The high value of the coefficient of non-linearity of the zinc oxide varistor and the presence of $SF_6$ at a pressure of several bars makes it easy to interrupt the current flowing through the switch.

This provides longitudinal protection as compared with conventional transverse protection (phase-ground) obtained with conventional lightening arrestors.

Figure 7:
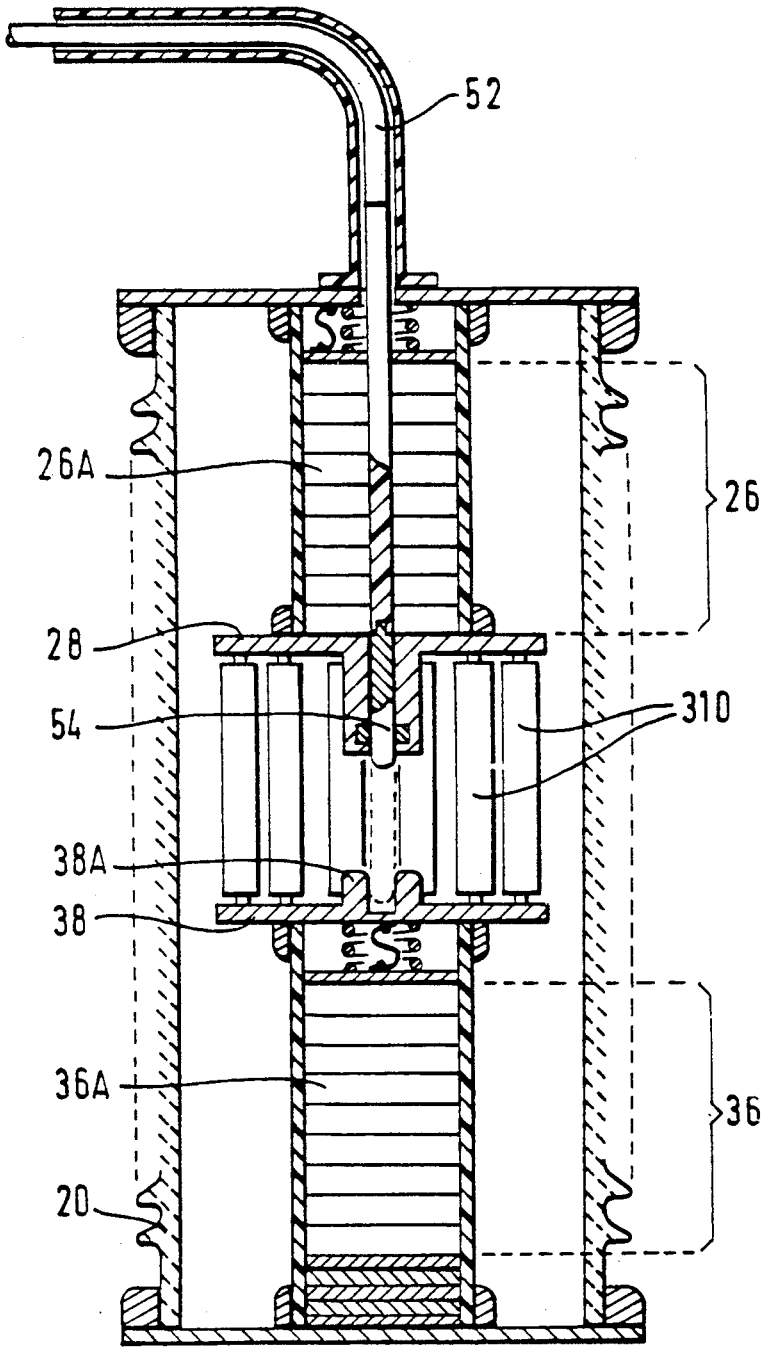
FIG. 7 is an axial section view through the case containing the varistor and the switch in series, with the capacitance of the switch being adjustable by means of ceramic capacitors.

FIG. 7 shows another embodiment. Items which are common to FIGS. 6 and 7 are given the same reference numerals.

The capacitance of the series switch is adjusted by disposing cylindrical components 310 between the plates 28 and 38 which are enlarged suitably for this purpose. These components may be made of quartz ARALDITE, a registered trademark for an epoxy resin, or of any other material having a large dielectric constant.

It is also possible to use one or more commercially available cylindrical ceramic capacitors of small diameter and of sufficient length to withstand the restored voltage.

For example, a ceramic capacitor having a length of 40 mm and a diameter of 18 mm could provide a capacitance of about 25 picofarads.

The invention is suitable for use in manufacturing circuit breakers for high tension lines (the circuit breakers may be conventional, i.e. having an insulating case, or they may be metal-clad), and the invention may also be used in circuit breakers used for connecting reactances or banks of capacitors.

We claim:

1. A circuit breaker comprising, for each pole, at least one interrupting chamber having fixed contacts and moving equipment including moving contacts, and in parallel with each interrupting chamber a series circuit comprising a varistor and a switch, said switch being open when the interrupting chamber contacts are disengaged and being closed when the interrupting chamber contacts are engaged, wherein said switch comprises a moving contact driven by the moving equipment during an engagement operation, said switch moving contact being constituted by a metal rod and being constrained to follow with a certain delay the movement of the moving equipment during a disengagement operation, said varistor being disposed in a case, said interrupting chamber being contained in another case, said varistor being constituted by two stacks of varistor components, the two stacks being separated by a distance not less than the isolation distance of the circuit breaker, one of the stacks having said switch moving contact constituted by said metal rod passing therethrough, the metal rod being fixed to a flexible metal drive member interconnecting the two cases, outside the cases and above them, and one end of the second stack of components being provided with a female contact for engaging said rod.

2. A circuit breaker according to claim 1, wherein said flexible drive member is fixed inside the case containing the interrupting chamber to an arm which is urged towards the moving equipment by a spring, said arm being capable of being put into mechanical contact with the moving equipment by means of insulating rods.

3. A circuit breaker according to claim 2, wherein said arm provided with a flange co-operating with a second cylinder which is fixed and which is provided with a flange to define a variable volume, said variable volume being at a maximum in an engaged position, said volume being closed, by leaky and constituting a device for delaying motion of said arm during a disengagement operation.

4. A circuit breaker according to claim 3, wherein one of said cylinders carries an adjustable valve.

5. A circuit breaker according to claim 1, wherein resistor disks are inserted in the varistor component stacks.

6. A circuit breaker according to claim 1, including means to give the series switch, when in the open position, a capacitance lying in the range 0.6 times to 1.1 times the capacitance of the varistor.

7. A circuit breaker according to claim 6, wherein said means comprise first and second facing fixed metal capacitor plates respectively in electrical contact with the moving contact and with the fixed contact of the switch.

8. A circuit breaker according to claim 7, wherein said capacitor plates are in the form of a rings.

9. A circuit breaker according to claim 7, wherein said capacitor plates have large flat facing areas.

10. A circuit breaker according to claim 6, wherein said means comprise at least one cylinder of material having a high dielectric constant, the cylinder being in electrical contact via its respective ends with fixed plates in electrical contact respectively with the moving contact and with the fixed contact of the switch.

11. A circuit breaker according to claim 10, wherein the cylinders are made of epoxy resin.

12. A circuit breaker according to claim 10, wherein the said cylinder is a commercially-available capacitor.

13. A circuit breaker comprising, for each pole, at least one interrupting chamber having fixed contacts and moving equipment including moving contacts, and in parallel with each interrupting chamber a series circuit comprising a varistor and a switch, said switch being open when said contacts are disengaged and being closed when said contacts are engaged, wherein said switch comprises a moving contact driven by the moving equipment during an engagement operation, said switch moving contact being a metal rod constrained to follow with a certain delay the movement of the moving equipment during a disengagement operation, and wherein the varistor is disposed in the same case as the interrupting chamber, with the varistor being constituted by two stacks of varistor components, the two stacks being separated by a distance not less than the isolation distance of the circuit breaker, and one of the stacks having said switch moving contact in the form of a metal rod passing therethrough, with the other stack being provided with a female contact for receiving said rod.

14. A circuit breaker according to claim 13, wherein said metal rod is fixed to a first end of an insulating rod whose other end is fixed to a moving arm, said arm being urged by a spring towards the moving equipment, said arm being put into contact with the moving equipment by means of insulating rods, arms and fingers.

15. A circuit breaker according to claim 14, wherein said arm carries a first cylinder provided with a flange and co-operating with a second cylinder which is fixed and provided with a flange to define a variable volume, said volume being at a maximum when in an engaged position, said volume being closed, but leaky and constituting a device for delaying the motion of said arm during a disengagement operation.

16. A circuit breaker according to claim 15, wherein one of said cylinders carries an adjustable valve.

17. A circuit breaker comprising, for each pole, at least one interrupting chamber having fixed contacts and moving equipment including moving contacts, and in parallel with each interrupting chamber a series circuit comprising a varistor and a switch, said switch being open when said contacts are disengaged and being closed when said contacts are engaged, wherein said switch comprises a moving contact driven by the moving equipment during an engagement operation, said switch moving contact being a metal rod constrained to follow with a certain delay the movement of the moving equipment during a disengagement operation, and wherein the varistor is disposed in the same case as the interrupting chamber, the varistor being constituted by a single stack of varistor components, said switch moving contact being in the form of a metal rod fixed to a moving arm, said arm sliding in a guide tube fixed to an insulating cone, and one end of the stack carrying a female contact that co-operates with said rod.

18. A circuit breaker according to claim 17, wherein said arm carries a first cylinder provided with a flange and co-operating with a second cylinder which is fixed and provided with a flange, to define a variable volume, said variable volume being at a maximum in an engaged position, said volume being closed, but leaky and constituting a device for delaying the motion of said arm during a disengagement operation.

19. A circuit breaker according to claim 18, wherein one of said cylinders carries an adjustable valve.

20. A circuit breaker according to claim 19, wherein said flexible drive member is in contact with the operating rod of the circuit breaker via a delay member.

21. A circuit breaker comprising, for each pole, at least one insulating case containing an interrupting chamber with fixed contacts and with moving equipment including moving contacts, and a second insulating case containing a series connection of a varistor and a switch connected in parallel with each interrupting chamber, said switch being open when said contacts are disengaged and closed when said contacts are engaged, said circuit breaker further including a resistance inside each interrupting chamber and associated with a mechanism for inserting the resistance briefly during a closing operation, and wherein said switch includes a switch moving contact connected to the mechanism for inserting the resistance by a continuous flexible drive member confined in a sheath, extending between and interconnecting the two cases, outside the cases.

* * * * *